United States Patent [19]

Yokoyama et al.

[11] Patent Number: 4,991,501

[45] Date of Patent: Feb. 12, 1991

[54] DAMPENING WATER FEED ROLLER FOR PLANOGRAPHIC PRINTING PRESS

[75] Inventors: Kazuhiro Yokoyama; Masami Akiyama; Teiichi Ando; Yasutaka Kojima, all of Tokyo, Japan

[73] Assignees: Nippon Steel Corporation; Akiyama Printing Machinery Manufacturing Corp., Tokyo, both of Japan

[21] Appl. No.: 390,373

[22] Filed: Aug. 8, 1989

[51] Int. Cl.[5] ..... B41F 7/26

[52] U.S. Cl. ..... 101/148; 29/895.32; 29/132

[58] Field of Search ..... 101/148, 147; 29/132, 29/895.32, 895.3, 895

*Primary Examiner*—Clifford D. Crowder

*Attorney, Agent, or Firm*—Wenderoth, Lind & Ponack

[57] ABSTRACT

A dampening water feed roller, characterized by a process of manufacturing which comprises forming a flame sprayed layer of a ceramic material composed of $Al_2O_3$, $TiO_2$, or a mixture of $Al_2O_3$ and $TiO_2$ on the peripheral surface of a metallic roller, subjecting the flame sprayed ceramic layer to a pore-occluding treatment with a hydrophilic $SiO_2$ type inorganic pore-occluding agent, and grinding the treated layer to surface roughness of not more than 1.6 S. The roller permits supply of the dampening water without using the additives such as isopropyl alcohol in the dampening water.

14 Claims, 2 Drawing Sheets

DAMPENING WATER FEED ROLLER FOR PLANOGRAPHIC PRINTING PRESS

BACKGROUND OF THE INVENTION

1. Field of the Invention

This invention relates to dampening water feed rollers such as a master water roller and a water spreading roller which are used in a continuous water feed device in a planographic printing press.

The planographic printing is a process of printing which utilizes the nature of an oily ink to repel water and uses a printing plate having an oleophilic picture formed on a hydrophilic base. The printing is effected by indirect printing of the so-called offset printing technique which comprises alternately feeding water and ink to the plate surface, causing the ink selectively adhering to the picture portion of the plate surface to be transferred tentatively to a blanket, and transferring the ink from the blanket to an object of printing. The printing press to be used for the planographic printing, therefore, is inherently provided with a dampening mechanism for feeding water to the non-picture portion of the printing plate and an inking mechanism for feeding ink to the picture portion.

A notable example of the conventional dampening mechanism is configured as follows.

This dampening mechanism is provided with a metallic master water roller which is rotated while it is partly submerged in a water supply pan disposed underneath, together with a metering roller of rubber and a water applying roller of rubber which are both held in contact with the master water roller. In this mechanism, the water adhering to the surface of the master water roller and consequently ascending with the rotation of this roller is deprived of an excess portion thereof in consequence of its contact with the metering roller. The remaining water, owing to the contact of the master water roller and the water applying roller, is transferred to the water applying roller. The water applying roller, on contact with the plate cylinder, passes the water to the non-picture portion of the surface of plate cylinder. The water which remains after failure to adhere to the surface of the plate cylinder is returned from the plate cylinder back to the water supply pan through the medium of the intervening rollers.

Another dampening mechanism comprises a metallic water discharging roller which is rotated while it is partly submerged in a water supply pan installed underneath, a water transferring roller of rubber held in contact with the water discharging roller, a metallic water spreading roller held in contact with the water transferring roller, and a water applying roller of rubber held in contact with the water spreading roller. In this dampening water mechanism, the water adhering to the surface of the water discharging roller and consequently ascending from the water supply pan with the rotation of the water discharging roller is deprived of an excess portion thereof during the course of transfer through the medium of the water discharging roller and the water spreading roller, then guided to the water applying roller, and passed from the water applying roller to the non-picture portion of the surfaces of the plate cylinder with which the water applying roller comes into contact. The water which remains after failure to reach the picture portion of the surface of the plate cylinder is returned from the plate cylinder back to the water supply pan through the medium of the intervening rollers.

As described above, the dampening mechanism, owing to the alternate arrangement of rubber rollers and metallic rollers, is enabled to feed the water in the water supply pan to the non-picture portion of the plate cylinder and return the water remaining after failure to reach the picture portion back to the water supply pan through the medium of the intervening rollers.

2. Description of the Prior Art

It has been heretofore customary for the metallic rollers used in the dampening mechanism of the planographic printing press to have their surfaces coated with a hard chromium plating to acquire improved resistance to corrosion and abrasion and enhanced affinity for water.

In spite of the hard chromium plating of the nature described above, such metallic rollers as the master water roller and the water spreading roller which are used in the dampening mechanism are still deficient in hydrophilicity and water-retaining property and, therefore, entail the following difficulties in printing. The water film on these rollers draws into drops or loss uniformity and impairs the uniformity of density of the ink film on the plate cylinder; the uniformity of supply of the dampening water is disrupted and, as the result, the so-called halftone of the picture portion is deprived of definition; and the dampening water is not fed sufficiently to the non-picture portion of the plate and, as the result, the ink adheres to the non-picture portion and smears the plate surface.

Further, when the water which remains after failure to reach the picture portion of the plate cylinder is returned to the water supply pan through the medium of the intervening rollers as described above, the ink on the picture portion of the plate cylinder is partly entrained by the water applying roller and passed in the form of emulsified ink to the surfaces of the rollers. Since these metallic rollers are deficient in hydrophilicity, they do not manifest the action of repelling the emulsified ink sufficiently and consequently suffer from fast deposition of the emulsified ink. Once the ink is deposited fast, the supply of the dampening water to the non-picture portion of the plate can no longer be continued. Thus, the non-picture portion of the plate is smeared with the adhering ink. For the plate cylinder to provide fine printing at all times, therefore, the printing press must be stopped periodically to permit cleaning of the defiled plate surface.

From this point of view, the idea of incorporating isopropyl alcohol or other similar alcohol and a surfactant in the dampening water thereby lowering the water surface tension and enhancing the water's ability to wet the metallic rollers has found acceptance. The incorporation of such substances as alcohol and surfactant in the dampening water, however, adds to cost and jeopardizes the hygienic condition of the workshop environment and causes the undesirable phenomenon of swelling in the rubber rollers which are exposed to the dampening water.

Japanese Utility Model Publication SHO 55(1980)-14,518 discloses a water spreading roller having a porous layer formed on the surface of a steel pipe or stainless steel pipe by the flame spraying of ceramic, and Japanese Utility Model Unexamined Publication SHO 62(1987)-116,869 discloses a master water roller having a layer of an oxide type ceramic formed by plasma flame spraying. These rollers merely have layers formed on metallic pipes by the flame spraying of ceramic. These layers are claimed to possess a porous surface. As recited in Japanese Utility Model Publication SHO 55(1980)-14,518, the porosity of surface is aimed at enhancing the rollers' water-retaining property. The enhancement of the water-retaining property due to the porous ceramic coating, however, is excessive for the master water roller or the water spreading roller. The water is suffered to ascend overly to the plate cylinder and the ink is rendered susceptible to emulsification. Since the master water roller and the water spreading roller are rotated as held in contact with the water applying roller, the ink adhering to the surface of the water applying roller permeates into the pores of the ceramic coating on the rollers and manifests an action of repelling water and impairs the hydrophilicity required of these rollers. Thus, the stable supply of the dampening water can be no longer be attained unless the dampening water incorporates therein an alcohol.

Japanese Utility Model Unexamined Publication SHO 62(1987)-116,868 discloses a dampening roller provided with a coating layer of an oxide type ceramic composed of 40 to 80% by weight of $Cr_2O_3$, 10 to 30% by weight of $Al_2O_3$, and 10 to 30% by weight of $SiO_2$, and Japanese Utility Model Unexamined Publication SHO 62(1987)-136,353 discloses a dampening roller having a layer of an oxide type ceramic formed by plasma flame spraying and having the porous part of the flame sprayed layer occluded with an oxide type ceramic coating agent composed of 40 to 80% by weight of $Cr_2O_3$, 10 to 30% by weight of $Al_2O_3$, and 10 to 30% by weight of $SiO_2$. These dampening rollers have a surface layer formed of a compact oxide complex ceramic material using $Cr_2O_3$ as a matrix or a surface layer formed of an oxide ceramic material by flame spraying and additionally have the pores in the surface layer occluded with a coating agent, so as to acquire enhanced hydrophilicity owing to the use of a ceramic layer on the surface. The $Cr_2O_3$ ceramic substance has no conspicuous effect in improving the rollers wettability with water. Even by the use of rollers of such a structure, the dampening mechanism cannot be operated satisfactorily when the dampening water incorporates absolutely no alcohol therein. Moreover, the oxide composite ceramic layer of compact texture using $Cr_2O_3$ as a matrix is expensive because the production thereof requires the immersion in the $Cr_2O_3$ slurry and the heating to 400° to 500° C. to be alternately repeated several to ten or more times.

SUMMARY OF THE INVENTION

An object of this invention, therefore, is to provide a novel dampening water feed roller. Another object of this invention is to provide an inexpensive dampening water feed roller excellent in wettability with water and incapable of entraining the ink. A further object of this invention is to provide a dampening water feed roller which has no use for the incorporation of alcohol in the dampening water, permits stable supply of the dampening water, and ensures production of prints of high quality. Yet another object of this invention is to provide a dampening water feed roller excellent in resistance to corrosion and abrasion.

The objects mentioned above are accomplished by a dampening water feed roller, characterized by a process of manufacture which comprises forming a layer of a ceramic material comprising 100 to 0% by weight of $Al_2O_3$ and 0 to 100% by weight of $TiO_2$ by flame spraying on the peripheral surface of a metallic roller, subjecting the flame sprayed ceramic layer to a pore-sealing treatment with a hydrophilic $SiO_2$ type inorganic sealing agent, and grinding the treated ceramic layer to surface roughness of not more than 1.6 S.

The inventors have examined various flame sprayed ceramic coatings with respect to their wettability with water (incorporating absolutely no isopropyl alcohol) as described specifically herein below, to find that as compared with the hard chromium coating produced by plating, the ceramic coatings as a whole possess high wettability, particularly the $Al_2O_3$-$TiO_2$ type ceramic coatings such as $Al_2O_3$-40% $TiO_2$, $Al_2O_3$-13% $TiO_2$, $Al_2O_3$-2.7% $TiO_2$. The present inventors have also found that $Al_2O_3$ and $TiO_2$ coatings among other ceramic coatings exhibit the most satisfactory wettability, and that the $Cr_2O_3$ component type coatings such as the coating produced by flame spraying $Cr_2O_3$, and the coating produced by the pore-sealing treatment with a $Cr_2O_3$ sealing agent as disclosed in Japanese Utility Model Unexamined Publication SHO 62(1987)-136,353 manifest no appreciably improved wettability. They have further examined the coatings as to the adhesiveness of ink to their surfaces by wetting their surfaces with water and subsequently allowing the ink to spread on the surfaces, to find that the hard chromium coating of poor wettability with water permits adhesion of the largest amount of ink and the flame sprayed coatings exhibiting a desirable water-retaining property and yet containing pores of a large diameter admit the ink in their pores and consequently sacrifice the hydrophilicity and suffer adhesion of the ink. For the ceramic coating produced by flame spraying to prevent the ink from permeating into the pores, therefore, it must be subjected to the pore-occluding treatment. Various organic and inorganic sealing agents are available for the purpose of the occlusion of pores. Some of these sealing agents such as the aforementioned $Cr_2O_3$ type agent are not incapable of seriously impairing the wettability of the coating produced by flame spraying. The inventors have continued a diligent study to find that a $SiO_2$ type inorganic pore-occluding agent is suitable as an agent which displays a remarkable ability to permeate micropores during the course of application to a porous surface and, on being dried and cured, gives rise to a coating of high hydrophilicity. The coating of this pore-occluding agent itself possesses lower hydrophilicity than the flame sprayed coating of $Al_2O_3$-$TiO_2$ ceramic material and offers no sufficient resistance to abrasion. It is, therefore, essential that the roll which has undergone the pore-occluding treatment should be ground to an extent of removing the $SiO_2$ coating and allowing the cured $SiO_2$ agent to remain only in the pores. It has been found that when this grinding is carried out to a surface roughness of not more than 1.6 S, the ground surface acquires uniform wettability with water and perfectly precludes the entrainment of ink by the ceramic coating. This invention has been accomplished as the result. The term "surface roughness" as used in the present specification refers to the definition given in Japanese Industrial Standard (JIS) B 0601.

The dampening water feed roller of the present invention enjoys much better resistance to abrasion than the roller provided with a hard chromium plating because it possesses an $Al_2O_3$-$TiO_2$ surface coating formed by flame spraying.

DETAILED DESCRIPTION OF THE INVENTION

Now, the present invention will be described in detail below with reference to embodiments thereof.

Figure 1:
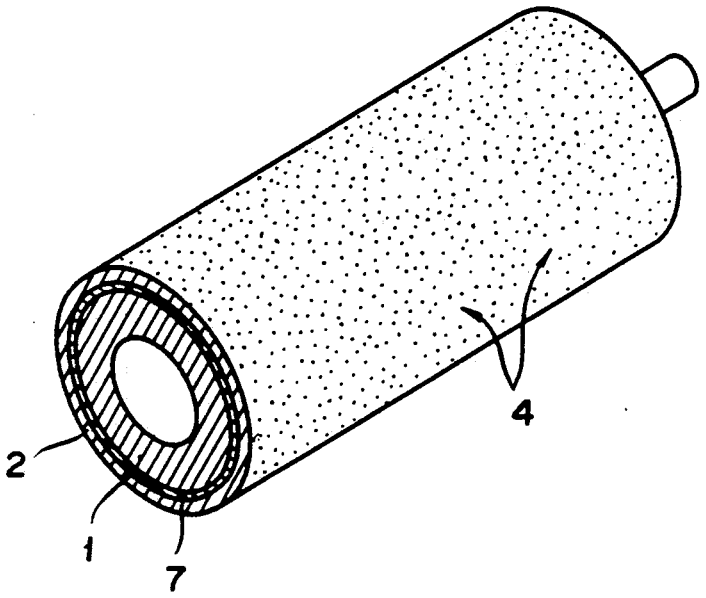
FIG. 1 is a perspective view illustrating as example of the structure of a dampening water feed roller of this invention, showing the roller in cross-section along the central part thereof.
Figure 2:
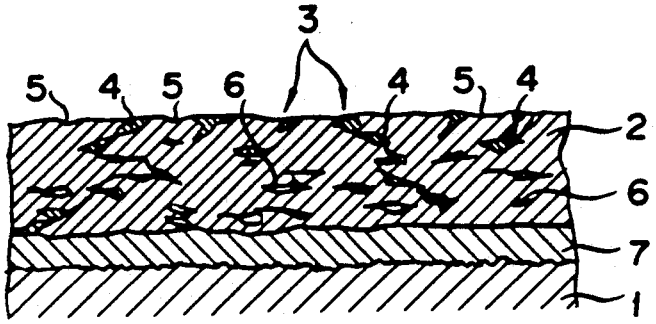
FIG. 2 is a magnified cross-section view illustrating an example of the microfine structure of the surface portion of a dampening water feed roller of this invention.

As illustrated in FIG. 1 and FIG. 2, in the dampening water feed roller of this invention, an $Al_2O_3$-$TiO_2$ type flame sprayed coating 2 is formed on the peripheral surface of a metallic roller 1 and pores 3 opening on the surface of the flame sprayed coating 2 are filled with a $SiO_2$ type inorganic pore occluding agent 4. On the surface of the flame sprayed coating 2, however, there also exist minute pores 5 which have been opened in consequence of the secondary grinding to be performed as described specifically herein below and have been left unfilled with the pore-occluding agent 4.

To facilitate the comprehension of this invention, the $Al_2O_3$-$TiO_2$ type flame sprayed coating 2 and the metal flame sprayed layer 7 to be mentioned herein below are illustrated with exaggerated thickness in FIG. 1 and the open pores 3, 5 and the closed pores 6 in the $Al_2O_3$-$TiO_2$ type flame sprayed coating 2 are illustrated in exaggerated sizes relative to the thickness of the coating in FIG. 2.

A metallic roller 1 destined to serve as a matrix for the dampening water feed roller of this invention is not specifically restricted. Suitably, it is a roller made of steel pipe or a stainless steel pipe. The metallic roller 1, prior to the formation of the $Al_2O_3$-$TiO_2$ type flame sprayed coating 2 on the peripheral surface thereof, is subjected to a blasting treatment and optionally a treatment for thermal spraying of such a corrosionproofing metal as Ni, Ni-Cr, or Ni-Al for the purpose of improving the corrosionproofness of the matrix and enhancing the adhesiveness of the matrix to the ceramic substance. When the flame spraying is carried out, the flame sprayed metal layer 7 to be formed suitably has a thickness approximately in the range of 50 to 100 μm.

Then, on the peripheral surface of this metallic roller 1, the $Al_2O_3$-$TiO_2$ type flame sprayed coating 2 is formed by any of various flame spraying methods represented by the plasma flame spraying method. The ratio of the $Al_2O_3$ and $TiO_2$ contents in the $Al_2O_3$-$TiO_2$ type flame sprayed coating 2 need not be specifically defined because this coating acquires sufficient hydrophilicity when the $Al_2O_3$ content falls in the range of 100 to 0% by weight and the $TiO_2$ content falls accordingly in the range of 0 to 100% by weight. In consideration of the impartation of more thorough hydrophilicity and economy, the $Al_2O_3$-$TiO_2$ type composition is desired to have an $Al_2O_3$ content in the range of 97.3 to 60% by weight and a $TiO_2$ content in the range of 2.7 to 40% by weight. The surface roughness of the roller, as described above, constitutes itself an important factor for determining the uniform wettability of the roller with water and the adhesiveness of ink to the roller surface. The $Al_2O_3$-$TiO_2$ type flame sprayed coating 2 formed by the flame spraying method is desired to undergo primary grinding and acquire surface roughness of not more than 6.3 S, preferably not more than 3.2 S. For the $Al_2O_3$-$TiO_2$ type flame sprayed coating 2 to possess sufficient layer strength and abrasionproofness, it is desired to possess a thickness approximately in the range of 100 to 300 μm, preferably 100 to 200 μm, after the primary grinding.

After the $Al_2O_3$-$TiO_2$ type flame sprayed coating 2 of a smooth surface has been formed on the peripheral surface of the metallic roller 1 as described above, it is subjected to a pore-occluding treatment with a $SiO_2$ type inorganic pore-occluding agent 4 to occlude the pores 3 opening on the surface of the $Al_2O_3$-$TiO_2$ type flame sprayed coating 2. The $SiO_2$ type inorganic pore-occluding agent 4 to be used in the present invention is only required to be such that it will form, on being dried or fired, a coating of $SiO_2$ as a main component thereof, desirably containing not less than 55% by weight, preferably not less than 80% by weight of $SiO_2$ and assume the form of a varying silicon compound at the time of use. The $SiO_2$ type inorganic pore-occluding agents which are usable herein include the product of Okuno Chemical Industries Co. LTD. marketed under product code of "CRM-100," the product of SUNRUKU K.K. marketed under product code of "HS-2," the product of SUNRAKU K.K. marketed under product code of "HS-K," the product of Nippan Kenkyujyo marketed under trademark designation of "Gulasuka 101," and the product of Nippan Kenkyujyo marketed under trademark designation of "Gulasuka 101A," for example, which are offered in the form of a solution diluted with a suitable solvent such as, for example, water or an alcohol. These are desirable because they are easily handled for the treatment. When the pore-occluding agent in the form of a solution as mentioned above is used, the pore-occluding treatment is carried out by immersing the $Al_2O_3$-$TiO_2$ type flame sprayed coating 2 in the pore-occluding agent, thereby allowing the pore-occluding agent to permeate into the pores 2 of the coating 2 and then drying or firing the pore-occluding agent at suitable temperature. Besides the commercial products enumerated above, the alkali metal-silicate type, silica sol type, and metal alkoxide type agents may be cited as examples of the $SiO_2$ type inorganic pore-occluding agent 4.

The $SiO_2$ type inorganic pore-occluding agent 4 manifests a notable ability to permeate into the micropores. By the surface of the $Al_2O_3$-$TiO_2$ type flame sprayed coating 2 are occluded intimately to a great depth. The coating of the $SiO_2$ type inorganic pore-occluding agent 4 formed on the surface of the roller in consequence of the pore-occluding treatment has lower hydrophilicity than the $Al_2O_3$-$TiO_2$ type flame sprayed coating 2 and exhibits no sufficient resistance to abrasion. If this coating is allowed to remain intact, the roller is prevented from manifesting the highly desirable hydrophilicity due to the $Al_2O_3$-$TiO_2$ type flame sprayed coating 2 and the roller is compelled to suffer from serious impairment of service life due to coarseness of the roller surface. The roller which has undergone the pore-occluding treatment, therefore, is subjected to second grinding so that the coating of the $SiO_2$ type inorganic pore-occluding agent 4 will be removed from the roller surface and the $SiO_2$ type inorganic pore-occluding agent 4 will be allowed to remain only in the pores 3 of the $Al_2O_3$-$TiO_2$ type flame sprayed coating 2. As concerns the extent to which the secondary grinding is performed, since the SiO type inorganic pore-occluding agent 4 possesses a notable ability as described above and the pores 3 opening in the surface of the $Al_2O_3$-$TiO_2$ type flame sprayed coating 2 are occluded therewith to a great depth, the possibility of the occluded pores being reopened by secondary grinding is very remote even when the grinding is made to a fairly large depth such as, for example, 30 μm. In due consideration of the possibility that the fine pores existing in the $Al_2O_3$-$TiO_2$ type flame sprayed coating 2 will be opened anew by the grinding, it is desirable that the secondary grinding should be limited to the extent of not more than 2 μm in depth. By the second grinding, the roller is desired to acquire surface roughness of not more than 1.6 S, preferably not more than 0.8 S. Even when the roller has the surface thereof covered with a compact ceramic coating of very high hydrophilicity, any insufficiency of surface smoothness entails the possibility that this roller will scrape the ink off the water applying roller, give rise to a suspension of ink in the water supply pan, pass the scraped ink onto the metering roller, with the result that the master water roller fails to manifest uniform wettability with water and the produced printed picture is smeared with the astray ink.

Figure 3:
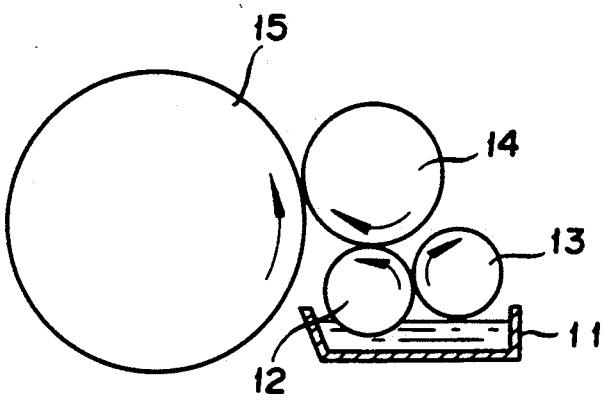
FIG. 3 and FIG. 4 are schematic diagrams illustrating typical examples of the dampening mechanism in the planographic printing press.
Figure 4:
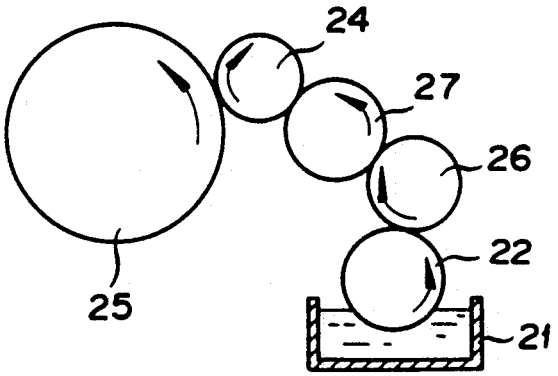

On the greater part of the surface of the dampening water feed roller of this invention, the $Al_2O_3$-$TiO_2$ type flame sprayed coating of very high hydrophilicity is formed. The small remaining part of the surface which is occupied by the open pores in the $Al_2O_3$-$TiO_2$ type flame sprayed coating is filled with the $SiO_2$ type inorganic pore-occluding agent of high hydrophilicity. As the result, the surface of the roller is formed of a compact ceramic coating of very high hydrophilicity and high surface smoothness. The roller of this surface, therefore, permits stable and uniform supply of the dampening water even though no additive such as isopropyl alcohol was added to the dampening water, and has no possibility of entraining the ink. There is no doubt that the roller also permits stable and uniform supply of the dampening water with using the additive in the dampening water. In this case, it is desirable that the amount of isopropyl alcohol incorporated to the dampening water is not more than 5% by weight, more particularly not more than 3% by weight. The dampening water feed roller of this invention, accordingly, is suitable for use as a dampening water feed roller of a varying dampening mechanism in the planographic printing press. Typical structures of the dampening water feed roller are illustrated in FIG. 3 and FIG. 4, for example. Of course, the dampening water feed roller of this invention need not be limited to the structures illustrated herein below but may be applied similarly to a varying dampening water feed mechanisms adapted for the planographic printing press.

The dampening mechanism illustrated in FIG. 3 comprises a master water roller which is 12 rotated while it is partly submerged in water in a water supply pan 11 disposed underneath it and a metering roller 13 of rubber and a water applying roller 14 of rubber both held in contact with the master water roller 12. The water adhering to the surface of the master water roller and consequently ascending with the rotation of the master water roller 13 is passed to the water applying roller 14 in consequence of the contact of the master water roller 12 with the water applying roller 14 and then is passed from the water applying roller 14 to the picture portion of a plate cylinder 15 on contact of the water applying roller 14 with the plate cylinder 15. The water which remains after failing to reach the picture portion of the plate cylinder 15 is returned from the plate cylinder 15 back to the water supply pan 11 through the medium of the intervening rollers. As the master water roller 12 in the dampening mechanism configured as illustrated in FIG. 3, the dampening water feed roller of this invention can be advantageously utilized in the place of the conventional metallic roller.

The other dampening mechanism illustrated in FIG. 4 comprises a water discharging roller which is 22 rotated while it is partly submerged in water of a water supply pan 21, a water transferring roller of rubber held in contact with the water discharging roller 22, a water spreading roller 27 held in contact with the water transferring roller 26, and a water applying roller 14 of rubber held in contact with the water spreading roller 27. In this dampening mechanism, the water adhering to the surface of the water discharging roller 12 and consequently ascending from the water supply pan 21 with the rotation of the water discharging roller 22 is deprived of an excess amount thereof during the passage thereof through the medium of the water transferring roller 26 and the water spreading roller 27, then guided to the water applying roller 24, and passed on from the water applying roller 24 to the plate cylinder 25 by virtue of the contact of the water applying roller 24 with the plate cylinder. The water which remains after failing to reach the picture portion of the plate cylinder 25 is returned from the plate cylinder 25 back to the water supply pan 21 through the medium of the intervening rollers. As the water discharging roller 22 and the water spreading roller 27, particularly as the water spreading roller 27, the dampening water feed roller of this invention can be advantageously utilized in the place of the conventional metallic roller.

EXAMPLES

Now, the present invention will be described more specifically below with reference to working examples. These examples are cited solely for the purpose of illustration of this invention. The scope of this invention is not limited in any way by the procedure of manufacture and the compositions specifically mentioned in the examples.

PRELIMINARY EXPERIMENT 1

First, to test various flame sprayed ceramic layers for wettability with water (containing absolutely no isopropyl alcohol), test pieces were prepared by flame spraying various ceramic substances indicated in Table 1 on substrates of steel plate 5×5 cm and the test pieces were dipped in water to find their angles of contact with water by the use of a contact angle meter (produced by Kyowa Kagaku K.K. and marketed under trademark designation of "Kyowa Contactanglemeter CA-A"). These flame sprayed ceramic layers were subjected to a pore-occluding treatment using a $SiO_2$ type inorganic pore-occluding agent, an epoxy type organic pore-occluding agent, or a $Cr_2O_3$ type pore-occluding agent and then tested similarly to angle of contact. As a control, a test piece was prepared by forming a hard chromium plating 30 pm in thickness on the surface of a similar steel plate and tested for wettability with water. The test piece of the hard chromium plating was additionally tested for wettability with water incorporating therein 10% of isopropyl alcohol. The results were as shown in Table 1. The flame sprayed ceramic layers were formed after the steel plates had been blasted to a surface roughness of Ra 40 μm and then coated with a flame sprayed Ni-Cr layer 50 μm in thickness.

PRELIMINARY EXPERIMENT 2

To test for adhesiveness of ink, test pieces were prepared by flame spraying $Al_2O_3$-40% $TiO_2$ on a substrate of steel plate 5×5 cm, flame spraying $Al_2O_3$-40% $TiO_2$ on a similar substrate and subjecting the flame sprayed layer to a pore-occluding treatment with a $SiO_2$ type inorganic pore-occluding agent (in conformity with the present invention), flame spraying $Al_2O_3$ on a similar substrate and subjecting the flame sprayed layer to a pore-occluding treatment with a $Cr_2O_3$ type pore-occluding agent, and coating a similar substrate with a hard chromium plating. These test pieces were wetted with water and ink was placed on the wetted surfaces and left to spread to determine the degrees of adhesion of ink to the test pieces. The results are shown in Table 2. The flame sprayed ceramic layers and the hard chromium plating were formed under the same conditions as in Preliminary Experiment 1, with necessary modifications.

TABLE 1

| Coating | Wettability with by angle of contact (%) |
|---|---|
| $TiO_2$ | 50 |
| $Al_2O_3$ - 40% $TiO_2$ | 60 |
| $Al_2O_3$ - 13% $TiO_2$ | 66 |
| $Al_2O_3$ - 2.7% $TiO_2$ | 70 |
| $Al_2O_3$ | 80 |
| $Cr_2O_3$ | 70 |
| WC - 25% Co | 80 |
| $Al_2O_3$ - 40% $TiO_2$ + pore-occluding treatment with $SiO_2$ type inorganic pore-occluding agent | 43 *1 |
| $Al_2O_3$ - 40% $TiO_2$ + pore-occluding treatment with epoxy type organic pore-occluding agent | 83 |
| $Al_2O_3$ + $Cr_2O_3$ type pore-occluding treatment | 70 |
| hard chromium plating | 84 |
| hard chromium plating (water incorporating 10% of isopropyl alcohol) | 55 *2 |

*1: Wettability of coating conforming to the present invention
*2: Wettability of conventional Cr plating with water incorporating 10% isopropyl alcohol

TABLE 2

| Coating | Adhesiveness of ink * |
|---|---|
| $Al_2O_3$ - 40% $TiO_2$ + $SiO_2$ type pore-occluding treatment | |
| $Al_2O_3$ - 40% $TiO_2$ (no pore-occluding treatment) | Δ |
| $Al_2O_3$ + $Cr_2O_3$ type pore-occluding treatment | |
| hard Cr plating | χ |

* The adhesiveness of ink was evaluated by visual observation and rated on a four point scale, wherein stand for substantial absence of adhesion, for presence of slight adhesion, Δ for presence of appreciable adhesion, and χ presence of conspicuous adhesion.

It is clearly noted from the results shown in Table 1 that the $Al_2O_3$-$TiO_2$ type ceramic substances, i.e. $Al_2O_3$-40% $TiO_2$, $Al_2O_3$-13% $TiO_2$, $Al_2O_3$-2.7% $TiO_2$, $Al_2O_3$, and $TiO_2$ which are suitable for use in the dampening water feed roller of the present invention invariably exhibited better wettability than not only the hard chromium plating but also other ceramic substances. When the $Al_2O_3$-$TiO_2$ type ceramic layers were subjected to the pore-occluding treatment, the $SiO_2$ type inorganic pore-occluding agent 4 for use with the dampening water feed roller of this invention, unlike other pore-occluding agents, brought about no hindrance whatever to the satisfactory wettability of the $Al_2O_3$-$TiO_2$ ceramic layers.

It is clearly noted from the results shown in Table 2 that the adhesiveness of ink to the surface depend heavily on the pore-occluding treatment.

EXAMPLE 1

On the peripheral surface of a master water roller of steel pipe which had been blasted to surface roughness of Rz 40 μm, Ni-Cr was flame sprayed in a thickness of 50 μm. On the flame sprayed Ni-Cr layer, $Al_2O_3$-40% $TiO_2$ was flame sprayed in a thickness of 250 μm by the plasma flame spraying technique. The $Al_2O_3$-40% $TiO_2$ ceramic layer thus formed was ground with a diamond grinding stone, #1000, to a depth of 150 μm and surface roughness of 0.8 S.

Then, a $SiO_2$ type inorganic pore-occluding agent (produced by Okuno Chemical Industries Co. LTD. and marketed under product code of "CRM-100") was applied on the flame sprayed $Al_2O_3$-40% $TiO_2$ ceramic layer by the immersion technique to occlude the pores and this layer was fired at 230° C. to complete a pore-occluding treatment. Subsequently, the coated roller was ground with a diamond grindstone, #4000, until the outside diameter thereof was ground down 2 um from that before the pore-occluding treatment so as to remove the coating of the $SiO_2$ type inorganic pore-occluding agent formed on the roller surface. In consequence of this grinding, the roller acquired surface roughness of 0.8 S.

EXAMPLE 2

A dampening water feed roller was produced by the procedure of Example 1, except that $Al_2O_3$-13% $TiO_2$ was used in the place of $Al_2O_3$-40% $TiO_2$.

EXAMPLE 3

A dampening water feed roller was produced by the procedure of Example 1, except that $Al_2O_3$-2.7% $TiO_2$ was used in the place of $Al_2O_3$-40% $TiO_2$.

CONTROL 1

A flame sprayed $Al_2O_3$-40% $TiO_2$ ceramic layer having a surface roughness of 2.2 S was formed on the same matrix as used in Example 1 by performing the same pretreatment, flame spraying $Al_2O_3$-40% $TiO_2$, and grinding of the coated matrix. The coated roller thus obtained was not subjected to the pore-occluding treatment but was used immediately as a dampening water feed roller.

CONTROL 2

A dampening water feed roller was produced by the procedure of Control 1, except that $Al_2O_3$-13% $TiO_2$ was used in the place of $Al_2O_3$-40% $TiO_2$.

CONTROL 3

A chromium-plated roller of the kind in popular use was produced by applying a hard chromium plating on the peripheral surface of a master water roller of steel and grinding the plating by buffing to a surface roughness of 0.2 S.

Actual printing test

The dampening water feed rollers of Examples 1 to 3 and Controls 1 to 3 produced as described above were each set in place in a commercial offset printing press provided with a dampening water feed mechanism using an array of rollers illustrated in FIG. 3 and subjected to a printing test under the conditions shown in Table 3, using water containing absolutely no isopropyl alcohol, water containing 3% by weight of isopropyl alcohol, and water containing 7% by weight of the alcohol respectively as the dampening water.

TABLE 3

| Conditions for actual printing test | | |
|---|---|---|
| Machine used | Bestech 640 (I type inking) | |
| Materials used | Plate | Akiyama test plate, 80% halftone (135 lines) Umpire photographic plate (4 colors) |
| | Ink | Dainippon Ink Process |
| | Paper | Double-face coated 76.5 Kg |
| Conditions for test | Dampening water temperature | 13° C. ± 2° C. |
| | pH | 5.5 (using H liquid made by Toho) |
| | Amount of isopropyl alcohol added | 7%, 3%, 0% |
| | Operating speed of printing press | 8,000 sheet/hour |

The chromium-plated roller of Control 3 produced uneven ascent of the dampening water containing no isopropyl alcohol and imparted the phenomenon of so-called "rainfall" to the print. The master water roller, therefore, entrained ink and prevented normal printing.

Even by the use of the dampening water containing no isopropyl alcohol, the rollers of Examples 1 to 3 could produce prints of a quality to or better than the print produced by the chromium-plated roller of Control 3 with the dampening water containing 7% by weight of isopropyl alcohol. The pictures printed were very sharp and glossy. The master water roller and the metering roller entrained virtually no ink. The printing press using these rollers could continue very stable printing for a very long time immediately after the start of paper feeding.

In the case of the rollers of Controls 1 and 2 which were not subjected to the pore-occluding treatment, they exhibited a high initial water-retaining property and brought about excessive ascent of water so that the ink was emulsified and was entrained by the master water roller to the metering roller or the ink was suspended in the water supply pan. They prevented the printing operation from being continued stably for a long time. When the use of the rollers was continued for a while, the ink permeated into the pores of the ceramic coatings. Since the ink repelled the ink repelled the water, the rollers brought about uneven ascent of water and smeared the prints and, at the same time, encouraged the entrainment of the ink by the rollers.

As described above, the dampening water feed roller of this invention possess high hydrophilicity, exhibits uniform wettability with water, and produces very uniform ascent of water. Thus, it allows a generous saving in the dampening water and permits production of fine prints of sharp and glossy pictures without use of any alcohol or other additive in the dampening water. It not merely reduces the cost owing to the omission of the use of such additives but also brings about a marketed advance in the improvement of the working environment. Further, since the use of the dampening water feed roller of this invention allows stable production of fine prints from the beginning, the effect brought about in the reduction of cost is remarkable even from the standpoint of the prevention of waste of paper and the enhancement of productivity. Moreover, since the dampening water feed roller of this invention exhibits outstanding resistance to abrasion and corrosion and enjoys a long service life and can be produced by a relatively simple procedure, the cost of its production is significantly low as compared with the dampening water feed roller configured as disclosed in Japanese Utility Model Unexamined Publication SHO 62(1987)-116,868 or Japanese Utility Model Unexamined Publication SHO 62(1987)-136,353. Thus, the present invention has a very large economic advantage.

It should also be understood that the foregoing relates to only the scope of the invention as defined by the apended claims rather than by the description preceding them, and all changes that fall within meets and bounds of the claims, or equivalence of such meets and bounds are therefore intended to embraced by the claims.

We claim:

1. A dampening water feed roller, characterized by a process of manufacture which comprises forming a flame sprayed layer of a ceramic material composed of $Al_2O_3$, $TiO_2$, or a mixture of $Al_2O_3$ and $TiO_2$ on the peripheral surface of a metallic roller, subjecting the flame sprayed ceramic layer to a pore-occluding treatment with a hydrophilic pore-occluding agent comprising $SiO_2$, whereby a pore-occluding layer is formed on the flame sprayed ceramic layer which occludes pores in said flame sprayed ceramic layer and which has a final content of $SiO_2$ after drying and/or firing in a range of not less than 55% $SiO_2$, and then grinding the thus treated peripheral surface of the metallic roller to a surface roughness of not more than 1.6 S, such that the only portion of the pore-occluding layer remaining on said flame sprayed ceramic layer after grinding exists in the pores of said flame sprayed ceramic layer.

2. A dampening water feed roller according to claim 1, wherein said surface roughness is not more than 0.8 S.

3. A dampening water feed roller according to claim 1, wherein said flame sprayed ceramic layer is composed of 97.3 to 60% by weight of $Al_2O_3$ and 2.7 to 40% by weight of $TiO_2$.

4. A dampening water feed roller according to claim 1, wherein a roller made of a steel pipe or a stainless steel pipe is used as the metallic roller.

5. A dampening water feed roller according to claim 1, wherein the peripheral surface of said metallic roller is subjected to a blasting treatment and then flame sprayed with a corrosionproofing metal selected from a group consisting of Ni, Ni-Cr and Ni-Al prior to the formation of a flame sprayed $Al_2O_3$-$TiO_2$ type coating thereon.

6. A planographic printing press which includes a water feed roller according to claim 1 in the dampening mechanism for feeding dampening water to the printing plate, whereby said press can use dampening water containing no alcohol.

7. A planographic printing press which includes a water feed roller according to claim 1 in the dampening mechanism for feeding dampening water to the printing plate, whereby said press can use dampening water containing not more than 5% by weight isopropyl alcohol.

8. A dampening water feed roller, characterized by a process of manufacture which comprises subjecting the peripheral surface of a roller made of a steel pipe or a stainless steel pipe to a blasting treatment, flame spraying the blasted peripheral surface with a corrosion-proofing metal selected from the group consisting of Ni, Ni-Cr and Ni-Al, then forming thereon a flame sprayed layer of a ceramic material composed of 97.3 to 60% by weight of $Al_2O_3$ and 2.7 to 40% by weight of $TiO_2$, subjecting said flame sprayed ceramic layer to primary grinding to a surface roughness of not more than 6.3 S, then subjecting the ground flame sprayed ceramic layer to a pore-occluding treatment with a hydrophilic pore-occluding agent comprising $SiO_2$, whereby a pore-occluding layer is formed on the flame sprayed ceramic layer which occludes pores in said flame sprayed ceramic layer and which has a final content of $SiO_2$ after drying and/or firing in a range of not less than 55% $SiO_2$, and then subjecting the thus treated peripheral surface of the metallic roller to secondary grinding to a surface roughness of not more than 1.6 S, such that the only portion of the pore-occluding layer remaining on said flame sprayed ceramic layer after secondary grinding exists in the pores of said flame sprayed ceramic layer.

9. A dampening water feed roller according to claim 8, wherein said primary grinding produces a surface roughness of not more than 3.2 S and said secondary grinding produces a surface roughness of not more than 0.8 S.

10. A planographic printing press which includes a water feed roller according to claim 8 in the dampening mechanism for feeding dampening water to the printing plate, whereby said press can use dampening water containing no alcohol.

11. A planographic printing press which includes a water feed roller according to claim 8 in the dampening mechanism for feeding dampening water to the printing plate, whereby said press can use dampening water containing not more than 5% by weight isopropyl alcohol.

12. A method for the production of a dampening water feed roller, which comprises a step of forming a flame sprayed layer of a ceramic material composed of $Al_2O_3$, $TiO_2$, or a mixture of $Al_2O_3$ and $TiO_2$ on the peripheral surface of a metallic roller, a step of subjecting the flame sprayed ceramic layer to a pore-occluding treatment with a hydrophilic pore-occluding agent comprising $SiO_2$, whereby a pore-occluding layer is formed on the flame sprayed ceramic layer which occludes pores in said flame sprayed ceramic layer and which has a final content of $SiO_2$ after drying and/or firing in a range of not less than 55% $SiO_2$, and a step of then grinding the thus treated peripheral surface or the metallic roller to a surface roughness of not more than 1.6 S, such that the only portion of the pore-occluding layer remaining on said flame sprayed ceramic layer after grinding exists in the pores of said flame sprayed ceramic layer.

13. A method for the production of a dampening water feed roller, which comprises a step of subjecting the peripheral surface of a roller made of a steel pipe or a stainless steel pipe to a blasting treatment, a step of flame spraying the blasted peripheral surface with a corrosionproofing metal, a step of forming thereon a flame sprayed layer of a ceramic material composed of 97.3 to 60% by weight of $Al_2O_3$ and 2.7 to 40% by weight of $TiO_2$, a step of subjecting said flame sprayed ceramic layer to primary grinding to a surface roughness of not more than 6.3 S, a step of subjecting the ground flame sprayed ceramic layer to a pore-occluding treatment with a hydrophilic pore-occluding agent comprising $SiO_2$, whereby a pore-occluding layer is formed on the flame sprayed ceramic layer which occludes pores in said flame sprayed ceramic layer and which has a final content of $SiO_2$ after drying and/or firing in a range of not less than 55% $SiO_2$, and a step of then subjecting the thus treated peripheral surface of the metallic roller to secondary grinding to a surface roughness of not more than 1.6 S, such that the only portion of the pore-occluding layer remaining on said flame sprayed ceramic layer after secondary grinding exists in the pores of said flame sprayed ceramic layer.

14. A method according to claim 13, wherein not more than 2 $\mu$m of the flame sprayed ceramic layer is ground away during said secondary grinding step.

* * * * *